United States Patent [19]

Bukajlo

[11] 4,274,260

[45] Jun. 23, 1981

[54] METHOD AND APPARATUS FOR REGULATING A STEAM TURBINE

[75] Inventor: Jerzy Bukajlo, Bois Colombes, France

[73] Assignee: BBC Brown Boveri & Company Limited, Baden, Switzerland

[21] Appl. No.: 6,476

[22] Filed: Jan. 24, 1979

[30] Foreign Application Priority Data

Jan. 31, 1978 [CH] Switzerland ..... 1014/78
Feb. 17, 1978 [CH] Switzerland ..... 1759/78

[51] Int. Cl.[3] ..... F01K 13/02
[52] U.S. Cl. ..... 60/663; 415/17
[58] Field of Search ..... 60/660, 663; 415/17

[56] References Cited

U.S. PATENT DOCUMENTS 3,097,490 7/1963 Callan et al. ..... 60/663 X
4,184,337 1/1980 Bloch ..... 60/660

*Primary Examiner*—Allen M. Ostrager
*Attorney, Agent, or Firm*—Werner W. Kleeman

[57] ABSTRACT

A method and apparatus for regulating a steam turbine comprising at least one resuperheater arranged between a high pressure section and a low pressure section and in which a reference-actual value comparison of the rotational speed is performed to produce an adjustment signal derived from the reference value actual-value difference which is delivered from the difference between the impeller casing pressure of the high pressure section and the output pressure of the resuperheater which feedback signal is coupled into the regulation circuit opposite to the adjustment signal.

5 Claims, 2 Drawing Figures

METHOD AND APPARATUS FOR REGULATING A STEAM TURBINE

CROSS-REFERENCE TO RELATED APPLICATIONS

Application Ser. No. 5,290, filed Jan. 22, 1979, and U.S. Pat. No. 4,184,337, granted Jan. 22, 1980, contain subject matter related to this application and are commonly assigned herewith.

BACKGROUND OF THE INVENTION

The invention relates to a method of regulating a steam turbine comprising at least one resuperheater arranged between a high pressure section and a low pressure section, wherein there is carried out a reference value-actual value comparison of the rotational speed and an adjustment magnitude derived from the reference value-actual value difference is delivered to a regulation valve arrangement. Further subject matter of the invention pertains to an apparatus for the performance of such method.

Steam turbine regulation encompasses a rotational speed regulation generally in the form of a direct rotational speed regulation with an essentially simple closed regulation circuit or in the form of a rotational speed regulation or frequency-output regulation, for instance, as an output regulation circuit having a subordinated rotational speed regulation circuit. In both instances there is carried out a reference value-actual value comparison of the rotational speed and there is derived, directly or indirectly, an adjustment magnitude from the reference value-actual value difference. For the stability and quality of the regulation, i.e., for a rapid and oscillation-free transition between different, steady state operating conditions following the occurrence of surge-like disturbances, for instance, due to load surges at the power supply network of an electrical generator coupled with the turbine, there is required an optimization of the transition behavior of the regulation circuit, with appropriate damping. For this optimization there are available for complex regulation circuits different transmission elements having adjustable or selectable parameters, which, however, are associated with a comparatively high circuit expenditure. Particularly in the case of installations using mechanical or hydraulic, proportional-functioning rotational speed regulation, the attainment of a rapid and oscillation-free rotational speed-transition behavior can cause difficulties. Thi is especially true in the case of turbine-generator units which work both in the so-called island mode of operation and also in compound operation.

SUMMARY AND OBJECTS OF THE INVENTION

Therefore, it is the objective of the invention to provide a regulation method and an appropriate apparatus, by means of which there can be obtained an advantageous rotational speed-transition behavior with comparatively low expenditure in regulation equipment, and specifically, especially for simple proportional-rotational speed regulation, for instance for turbines working in island and compound operation. The invention solution of such objective, with a method of the previously mentioned type, is characterized by the features appearing in claim 1.

With a change of the adjustment magnitude caused by a disturbance, for instance a load surge, the thus produced feedback magnitude functions in the manner of a negative feedback, thus basically reduces the corresponding change in the adjustment magnitude, however with a time-delay corresponding to the flow inertia of the resuperheater, i.e., in accordance with the time-delay time-constants of the pressure transmission by the resuperheater, briefly referred to as "resuperheater time-constant". Owing to this inertia the pressure at the output of the resuperheater reacts with a time-delay time-constant in the order of magnitude of several seconds upon an inlet side pressure change, i.e., essentially to an adjustment of the inlet valve of the preceding high pressure section of the turbine. The high pressure side measuring pressure follows with only slight time-delay the action of the regulation valve arrangement under the effect of the adjustment magnitude. The stabilizing action of the feedback therefore, roughly speaking, can be explained in terms that there is generally preferred the flow inertia of the resuperheater, and thus, the delayed reaction of the rotational moment component of the subsequent low pressure section, which can lead to overshooting and possibly instability. This delayed reaction of the regulation path can be more or less compensated by the available negative feedback, and the amplitude of the feedback magnitude, which decreases to null, avoids an additional static component, and thus, an additional stationary regulation error.

Basically, a steam pressure at the region between the inlet valves of the high pressure section and the inlet of the resuperheater can be used for the formation of the feedback magnitude, because the delays in the transition behavior of the steam pressure at such region are negligibly small for the present purposes. The measuring location need only be selected such that there is insured a stable, quasi-static pressure distribution. There is preferably used the impeller casing pressure of the high pressure section, because for such there is generally present anyway a measuring location, and therefore, there does not arise any additional expenditure.

Static pressure differences between the different measuring locations which come under consideration for the high pressure side measuring pressure are without any influence when they are conventionally standardized to a rated value. Such standardization will be hereinafter presupposed for all of the employed measuring pressures, without any particular explanation or separate showing being made.

As concerns the apparatus for the performance of the regulation method the subject matter of the invention encompasses a solution according to the features of claim 2.

This solution contemplates a difference formation of the pressures, converted into appropriate signals, at both sides of the resuperheater, whereby the difference, disappearing during steady state operation, of the standardized pressures before and after the resuperheater is employed for the decrease of the feedback magnitude to at least approximately null. Such circuit requires at the signal side somewhat lesser circuit expenditure, but however a larger equipment expenditure which generally is of greater significance. Also, owing to the arrangement of the single required pressure-measuring transducer at the region of the lower steam temperatures before the resuperheater and the thus lower transducer load as well as improved operational reliability, there is often to be preferred the first solution.

BRIEF DESCRIPTION OF THE DRAWINGS

Further features and advantages of the invention will be explained on the basis of the schematically illustrated embodiments of the drawings, wherein.

DETAILED DESCRIPTION OF THE PREFERRED EMBODIMENT

Figure 1:
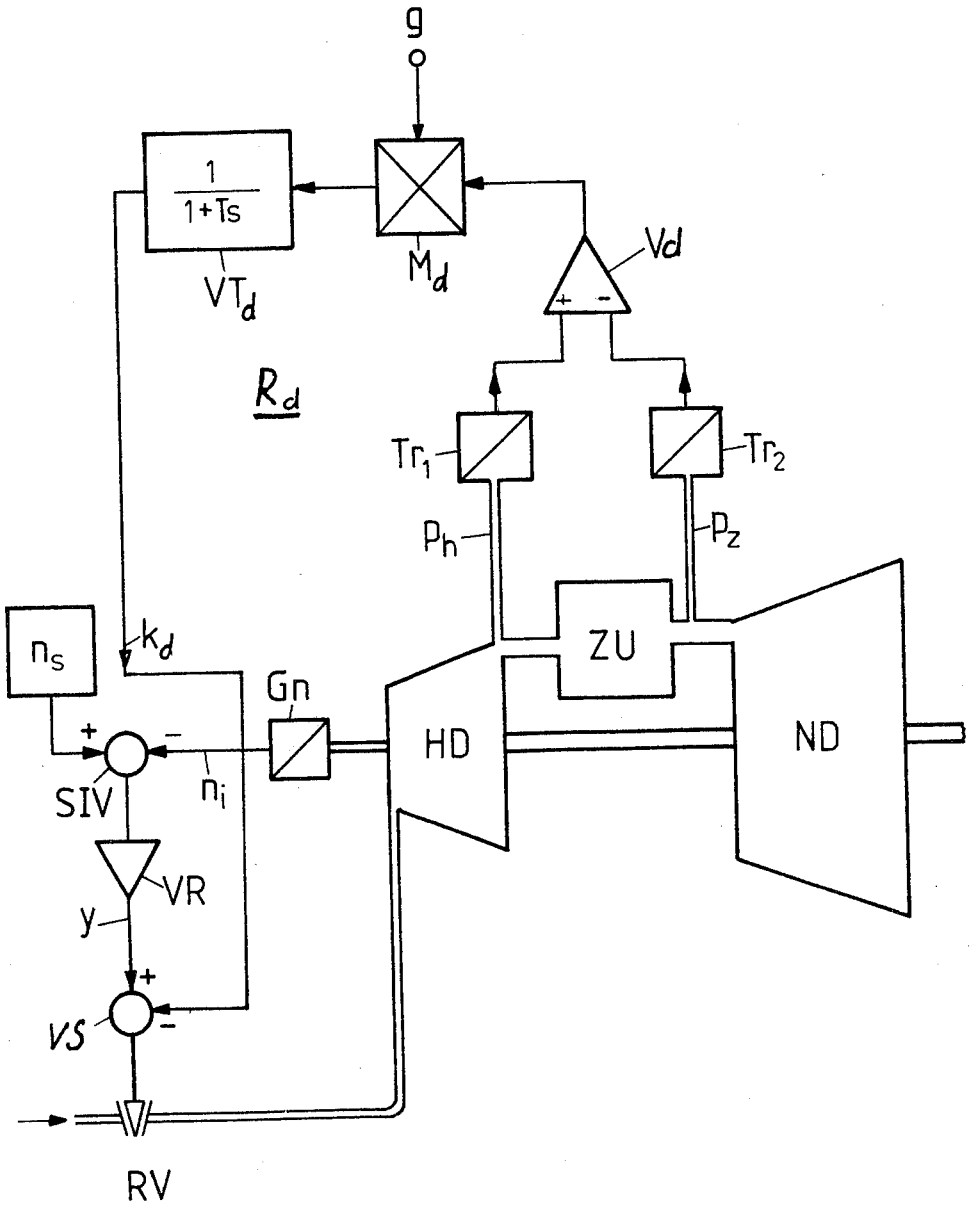
FIG. 1 is a functional diagram of a steam turbine regulation having feedback of a magnitude in the regulation system circuit and derived from the pressure difference across the resuperheater.

The turbine indicated in FIG. 1 comprises a high pressure stage HD, supplied by a regulation valve arrangement RV, and provided with a subsequently arranged resuperheater ZU and low pressure stage ND fed by the later. Connected with the turbine as the regulation path is a tachogenerator Gn serving as a measuring element, which converts the rotational speed of the turbine into an appropriate actual value signal $n_i$. The latter is subtractively superimposed upon a reference value signal $n_s$ delivered by an appropriate transmitter, in a superimposing element SIV functioning as a reference value-actual value comparator. The thus resulting reference value-actual value difference, in the case of the illustrated, simple proportional regulation, is converted in a regulation amplifier VR into an adjutment magnitude y, which by means of a not further illustrated, for instance, electrohydraulic transducer, controls the drive of the regulation valve arrangement RV.

Figure 2:
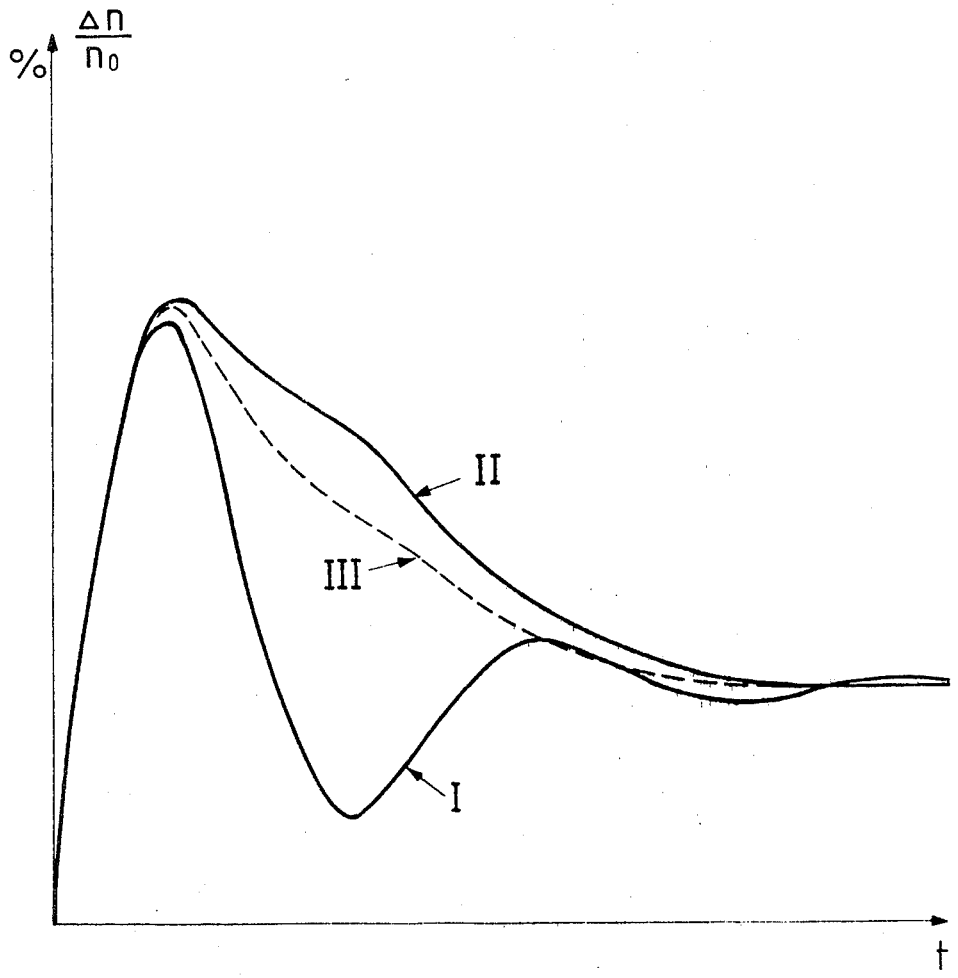
FIG. 2 is a graph which plots the rotational speed change $\Delta n$, related to the rated rotational speed $N_o$, as a function of time as the response to a surge-like reduction of the generator output (negative load surge).

Such rotational speed-regulation circuit, with a negative load surge, typically produces an equalization operation, as such has been indicated in FIG. 2 by the curve I. The rotational speed change $\Delta n/n_o$, related to the rated rotational speed $n_o$, following pronounced oscillations, which typically last for a time span of about 15 seconds, transforms into an essentially steady state value governed by the statics of the regulation circuit. The maximum overshoot amplitude of $\Delta n/n_o$ approximately attains the 2.5-fold value of the steady state rotational speed change. Such type transition behavior is particularly undesired or, in fact, impermissible for the island operation of a larger turbo-generator unit in consideration of the frequency fluctuations in the load network.

In the description to follow there will be presupposed, without further discussion, the standarization of the measuring pressures.

With this embodiment the feedback branch $R_d$ encompasses two pressure-measuring transducers $Tr_1$ and $Tr_2$, the first of which is connected with the impeller casing pressure of the high pressure section HD and the other of which is connected at the resuperheater pressure $p_z$. A difference former Vd forms a signal corresponding to the pressure difference across the resuperheater, which signal is converted, by means of a multiplier $M_d$ having adjustable gain g and a transmission circuit ($VT_d$), here constructed as a simple time-delay element, into a feedback magnitude $k_d$, for the subtractive superimposing with the adjustment magnitude y in an appropriate superimposing element VS. Owing to the increased apparatus expenditure for both measuring transducer arrangements there is not required at the signal side any particular D-component for the strived for yielding transition behavior as well as no simulation of the resuperheater pressure. Consequently the result is the use of a simple time-delay element having the time-constant T and adjustable proportional gain g in the multiplier $M_d$.

Curve II of FIG. 2 shows the effect of the feedback branch for the following parameter settings: amplification factor g=0.5, time-constant T=resuperheater time-constant. There will be apparent therefrom an appreciable improvement in the transition behavior while practically completely avoiding oscillations, and specifically, remarkably worthy of mention, practically without any delay of the maximum rotational speed evaluation in comparison to the maximum overshoot amplitude of the curve I. A still more extensive optimization of the parameter setting with g=1.5 and again T=resuperheater time-constant, is shown by curve III, which not only is free of oscillations, but also merges appreciably earlier than the curve II into the new steady state rotational speed value, and thus, corresponds approximately to the strived for ideal case of aperiodic damping. Thus, there are to be preferred amplification values in a range between 1 and 2. Tests which are not here further explained have produced the result that the time-delay time-constant T should not fall below the resuperheater time-constant, rather more likely should exceed such.

Although only a preferred embodiment is specifically illustrated and described herein, it will be appreciated that many modifications and variations of the present invention are possible in light of the above teachings and within the purview of the appended claims without departing from the spirit and intended scope of the invention.

I claim:

1. A method of regulating a steam turbine comprising at least one resuperheater arranged between a high pressure section having an impeller casing and a low pressure section having an impeller casing, comprising the steps of:
   - generating an actual-value signal proportional to the rotational speed of said turbine;
   - providing a reference-value signal;
   - comparing said actual-value and reference value signals to generate a first difference signal;
   - generating a first pressure signal proportional to the pressure in the impeller casing of said high pressure stage;
   - generating a second pressure signal proportional to the output pressure of said resuperheater;
   - producing a feedback magnitude signal proportional to the difference of said first and second pressure signals; and
   - subtracting said feedback magnitude signal from said first difference signal to produce a regulating signal for regulating said turbine.

2. The method of claim 1, wherein said step of producing a feedback magnitude signal comprises:
   - forming the difference between said first and second pressure signals; and
   - time-delaying said thus formed second difference signal.

3. The method of claim 2, further including the step of multiplying said second difference signal before performing said time-delaying step.

4. Apparatus for regulating a steam turbine comprising:

at least one resuperheater arranged between a high pressure section and a low pressure section of said turbine, said resuperheater having an output;

means for determining the rotational speed of said turbine and producing an actual-value signal representative thereof;

means for inputting a reference-value signal;

means for comparing said actual-value and said reference-value signals and producing an adjustment magnitude signal representative of the difference between said actual-value and reference-value signals;

a first pressure transducer connected to said high pressure stage for producing a first pressure signal proportional to the pressure in the impeller casing of said high pressure stage;

a second pressure transducer connected to the output of said resuperheater for producing a second pressure signal;

difference former means for receiving said first and second pressure signals and producing a feedback signal proportional thereto;

transmission circuit means for receiving and time-delaying said feedback signal to produce a feedback magnitude signal; and regulating means for receiving said adjustment magnitude and feedback magnitude signals and subtracting said feedback magnitude signals from said adjustment magnitude signals and producing a signal for regulating said turbine.

5. The apparatus of claim 4, wherein said regulating means regulates said high pressure stage of said turbine.

* * * * *